US011415922B2

(12) United States Patent
Wakana

(10) Patent No.: US 11,415,922 B2
(45) Date of Patent: Aug. 16, 2022

(54) TECHNOLOGY THAT SWITCHES UNITS FOR INSERTING INSERTION SHEET

(71) Applicant: CANON KABUSHIKI KAISHA, Tokyo (JP)

(72) Inventor: Toru Wakana, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/709,233

(22) Filed: Dec. 10, 2019

(65) Prior Publication Data

US 2020/0192268 A1 Jun. 18, 2020

(30) Foreign Application Priority Data

Dec. 17, 2018 (JP) ..... JP2018-235908

(51) Int. Cl.
*G03G 15/00* (2006.01)

(52) U.S. Cl.
CPC ..... *G03G 15/6502* (2013.01); *G03G 15/655* (2013.01); *G03G 15/6508* (2013.01)

(58) Field of Classification Search
CPC ..... B65H 2220/01; G03G 15/6508; G03G 15/655; G03G 15/502; G03G 2215/00734; G03G 2215/00729; G03G 2215/00894; G03G 2215/00869; G03G 2215/00725; G03G 2215/00358
See application file for complete search history.

(56) References Cited

U.S. PATENT DOCUMENTS 8,509,674 B2 * 8/2013 Shimada ..... G03G 15/655 399/382
2007/0263242 A1 * 11/2007 Takahashi ..... H04N 1/00413 358/1.14
2009/0304430 A1 * 12/2009 Vetromile ..... G03G 15/655 400/605
2016/0052310 A1 * 2/2016 Okada ..... H04N 1/00466 358/1.12
2017/0023901 A1 * 1/2017 Asakawa ..... G03G 15/5012

FOREIGN PATENT DOCUMENTS

JP 2007-168958 A 7/2007

* cited by examiner

*Primary Examiner* — Jessica L Eley
(74) *Attorney, Agent, or Firm* — Canon U.S.A., Inc. I.P. Division

(57) ABSTRACT

An image forming system comprises first and second sheet feeding trays and first and second inserter trays. If sheets that are loaded in the first inserter tray run out during execution of a job in which a sheet feeding source of an insertion sheet is set to the first inserter tray, the system switches from the first inserter tray to the second inserter tray and continues execution of the job. If sheets that are loaded in the second sheet feeding tray run out during execution of a job in which a sheet feeding source is set to the second sheet feeding tray, the system temporarily stops execution of the job without switching from the second sheet feeding tray to another tray.

10 Claims, 10 Drawing Sheets

| SHEET FEEDING SOURCE | SHEET SIZE | SHEET TYPE |
|---|---|---|
| FEEDING TRAY 110a | A4 | PREPRINTED SHEET |
| FEEDING TRAY 110b | A4 | PREPRINTED SHEET |
| FEEDING TRAY 110c | A4 | PLAIN PAPER |
| FEEDING TRAY 110d | A4 | PLAIN PAPER |
| FIRST INSERTER TRAY 117a | A4 | PREPRINTED SHEET |
| SECOND INSERTER TRAY 117b | A4 | PREPRINTED SHEET |

TECHNOLOGY THAT SWITCHES UNITS FOR INSERTING INSERTION SHEET

BACKGROUND

Field of the Disclosure

The present disclosure relates to a technology for switching units that insert an insertion sheet.

Description of the Related Art

An inserter is directly or indirectly connectable to an image forming apparatus. An inserter is a post-processing apparatus that inserts an insertion sheet (e.g.: front cover sheet, back cover sheet, interleaf sheet, chapter sheet) before or after a recording sheet. An image forming system of Japanese Patent Laid-Open No. 2007-168958 supplies sheets from a main body sheet feeding tray when a post-processing sheet feeding tray runs out of sheets, and supplies recording sheets from the post-processing sheet feeding tray when the main body sheet feeding tray runs out of sheets. Post-processing processes are thereby not interrupted, and an operation for replenishing sheets is no longer required.

Inserters may have a plurality of inserter trays. Image forming apparatuses may also have a plurality of sheet feeding trays. In particular, a plurality of sheet feeding trays allows for both loading of recording sheets and loading of insertion sheets. Accordingly, when a given inserter tray runs out of insertion sheets, the image forming system is able to continue a print job by switching the sheet feeding source to another inserter tray or a sheet feeding tray. Such switching is executed when an automatic switching mode is enabled. Although the same type of insertion sheet is generally loaded in the plurality of inserter trays, other types of insertion sheets and recording sheets can be loaded in the sheet feeding trays provided in the image forming apparatus. Accordingly, when the sheet feeding source of insertion sheets is switched without exception simply because the automatic switching mode is enabled, sheets different from those intended may be inserted before or after the recording sheets.

SUMMARY

The present disclosure provides an image forming system comprising the following elements. A first sheet feeding tray and a second sheet feeding tray ae capable of loading a plurality of sheets. An image formation unit is configured to form an image on a sheet fed from the first sheet feeding tray or the second sheet feeding tray. A first inserter tray and a second inserter tray are provided downstream of the image forming unit in a sheet conveyance direction and capable of loading a plurality of sheets. A control unit is configured to, if sheets that are loaded in the first inserter tray run out during execution of a job in which a sheet feeding source of an insertion sheet to be inserted between a plurality of sheets on which an image is formed by the image forming unit is set to the first inserter tray, switch from the first inserter tray to the second inserter tray and continue execution of the job, is configured to, if sheets that are loaded in the second sheet feeding tray run out during execution of a job in which a sheet feeding source of an insertion sheet to be inserted between a plurality of sheets on which an image is formed by the image forming unit is set to the second sheet feeding tray, temporarily stop execution of the job without switching from the second sheet feeding tray to another tray.

Further features of the present disclosure will become apparent from the following description of exemplary embodiments (with reference to the attached drawings).

DESCRIPTION OF THE EMBODIMENTS

Figure 1:
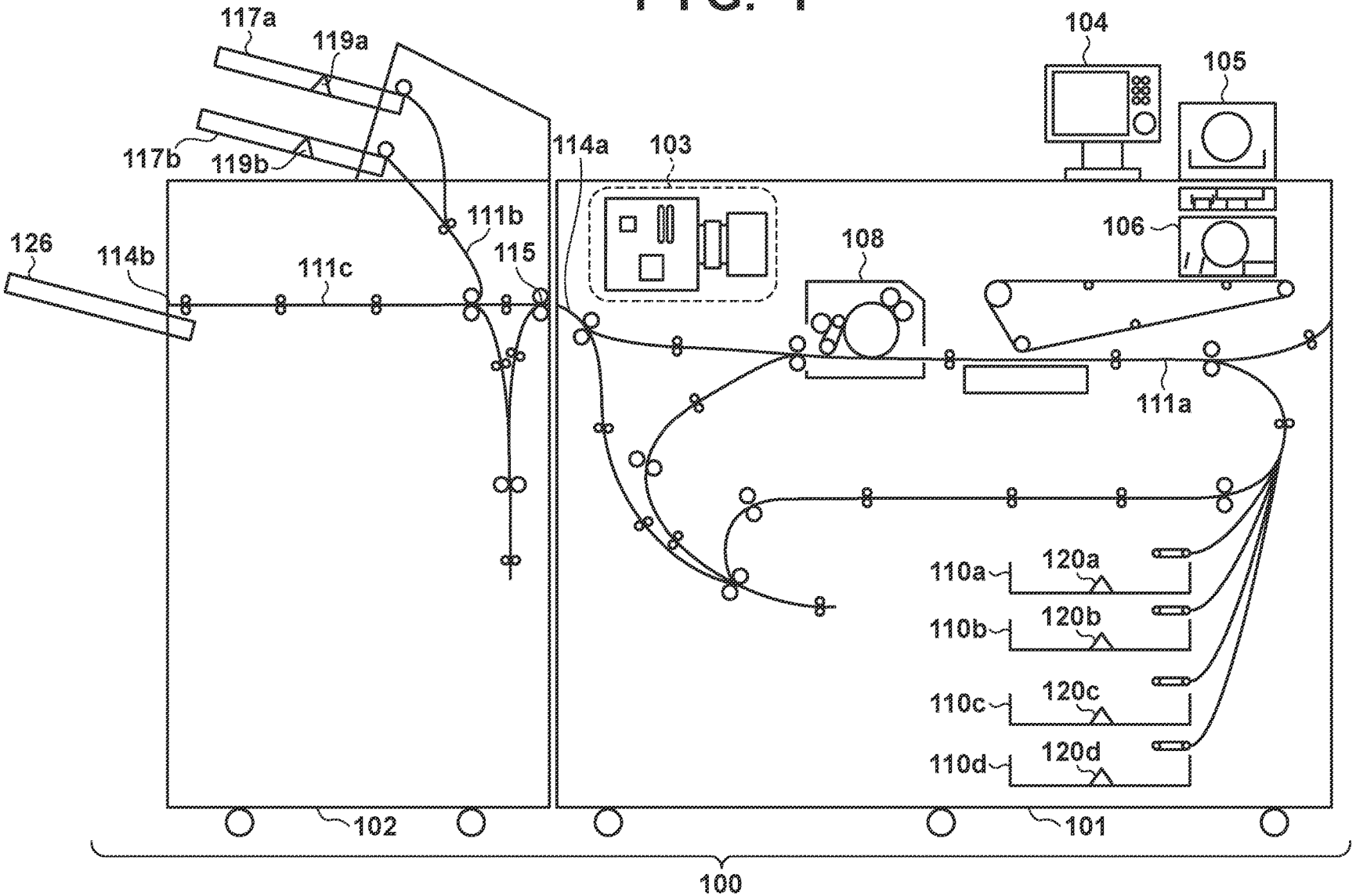
FIG. 1 is a diagram illustrating an image forming system.

Hereinafter, embodiments will be described in detail with reference to the accompanying drawings. It should be noted that the following embodiments are not intended to limit the disclosure as defined by the claims. Multiple features are described in the embodiments, although not all of these features are necessarily essential to the disclosure, and features may be freely combined. Furthermore, the same or similar components are given the same reference numerals throughout the accompanying drawings, and redundant description will be omitted.

Image Forming System

As shown in FIG. 1, an image forming system 100 has an image forming apparatus 101 and an inserter 102. In FIG. 1, the image forming apparatus 101 and the inserter 102 are directly connected, but the image forming apparatus 101 and the inserter 102 may be indirectly connected via other post-processing apparatuses. The image forming apparatus 101 is an apparatus that forms images on sheets (recording sheets). The inserter 102 is provided with an insert function of inserting insertion sheets such as preprinted sheets (e.g.: interleaf sheet, front cover sheet, back cover sheet, chapter sheet) before or after sheets output by the image forming apparatus 101. Preprinted sheets are sheets on which images are formed in advance before being loaded in the tray. The images on the preprinted sheets may be formed by the image forming apparatus 101, or may be formed by another image forming apparatus.

Image Forming Apparatus

A controller 103 executes software for variously controlling the image forming system 100. An operation unit 104 has an input device that receives input of instructions for the image forming system 100, and a display device that performs display such as information display to a user. The input device may be a touch panel or hard keys.

A toner supply unit 105 supplies toner which is a printing agent to an image forming unit 106 of the image forming system 100. The image forming unit 106 forms a toner image on a sheet using toner. A fixing device 108 applies heat and pressure to the toner image and the sheet, and fixes the toner image to the sheet. Feed trays 110*a*, 110*b*, 110*c* and 110*d* are sheet feeding trays that are each capable of loading a plurality of sheets, and feed sheets to a conveyance unit 111*a*. The conveyance unit 111*a* conveys sheets fed from the sheet feeding trays 110*a*, 110*b*, 110*c* and 110*d* to the image forming unit 106. A discharging unit 114*a* discharges sheets to which a toner image is fixed to the inserter 102. The letters appended to the end of reference signs are used in order to distinguish identical elements. Accordingly, when matters common to the plurality of elements are described, the letters on the end of the reference signs will be omitted.

Inserter

A feeding port 115 receives sheets discharged from the image forming apparatus 101. Inserter trays 117*a* and 117*b* are each a sheet feeding tray capable of loading a plurality of sheets that are used as insertion sheets. A sheet sensor 119*a* detects whether sheets are loaded in the inserter tray 117*a*. A sheet sensor 119*b* detects whether sheets are loaded in the inserter tray 117*b*. A conveyance unit 111*b*, by conveying insertion sheets fed from the inserter trays 117*a* and 117*b* to a conveyance unit 111*c*, inserts insertion sheets before or after sheets discharged from the image forming apparatus 101. The conveyance unit 111*c* conveys sheets discharged from the image forming apparatus 101 and insertion sheets fed from the inserter trays 117*a* and 117*b* to a discharging unit 114*b*. The discharging unit 114*b* discharges sheets and insertion sheets into a paper discharge tray 126. In FIG. 1, the paper discharge tray 126 connected to the inserter 102 is the final paper discharge destination, but post-processing apparatuses such as a puncher and a bookbinding device may be connected downstream of the inserter 102.

Controller

Figure 2:
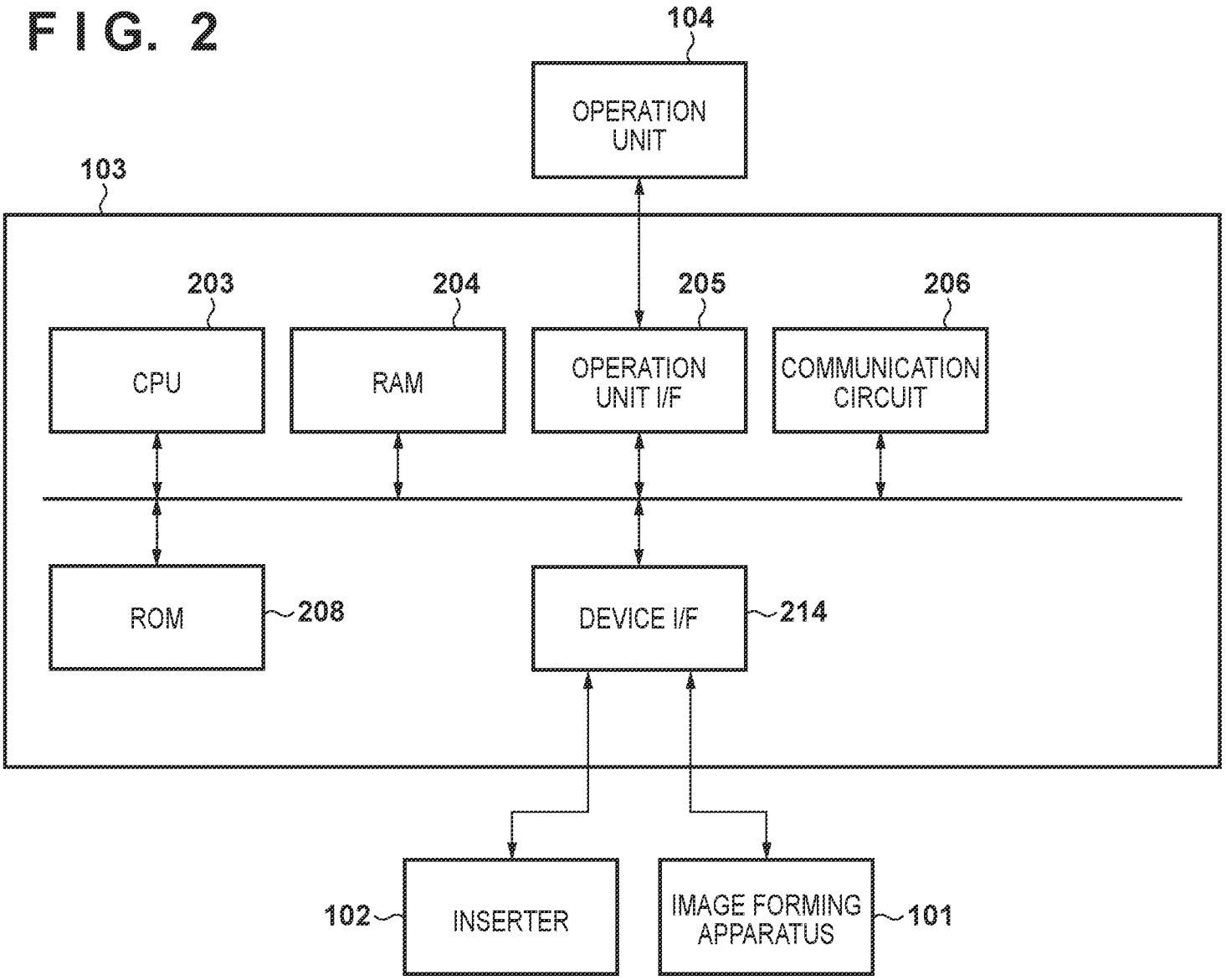
FIG. 2 is a diagram illustrating a controller.

As shown in FIG. 2, a CPU 203, by executing a control program that is stored in a ROM 208, controls the image forming apparatus 101 and the inserter 102. In FIG. 1, the controller 103 is provided inside of the image forming apparatus 101, but may be provided outside of the image forming apparatus 101 as shown in FIG. 2. A RAM 204 is a storage device that temporarily stores print jobs and the like. The ROM 208 is storage device that stores control programs, control data, and the like. An operation unit I/F 205 is a circuit for connecting the operation unit 104 to the CPU 203. A communication circuit 206 is a circuit that receives print jobs and the like from a host computer or an image scanner. A device I/F 214 transmits a sheet feeding command, an image forming command and the like to the image forming apparatus 101 or the inserter 102, and receives a detection signal indicating whether there are sheets from sheet sensors 119 and 120.

User Interface

Figure 3A:
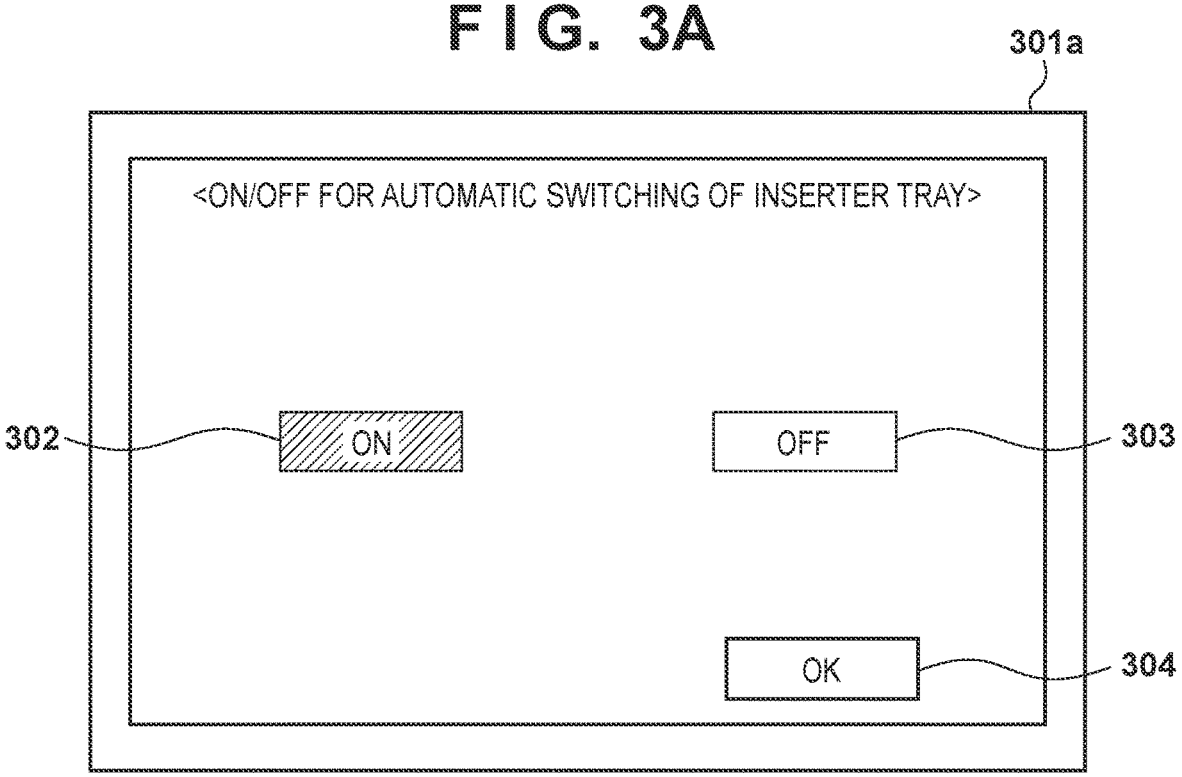
FIGS. 3A to 3C are diagrams illustrating a user interface.

FIG. 3A shows a setting screen 301*a* for setting automatic switching of the inserter trays. Automatic switching means continuing to feed sheets when a given inserter tray runs out of sheets, by switching the sheet feeding source from that inserter tray to another inserter tray. Automatic switching is one of the control modes, and thus may be referred to as an automatic switching mode. Automatic switching is executed in the case where sheets that are loaded in a given inserter tray are the same as sheets that are loaded in another inserter tray. For example, the inserter tray 117*a* and the inserter tray 117*b* are assumed to each be capable of holding and being loaded with 200 sheets. In this case, continuous feeding of 400 sheets becomes possible, by loading 200 of the same sheets in both the inserter tray 117*a* and the inserter tray 117*b*.

The controller displays the setting screen 301*a* on a display device of the operation unit 104. The setting screen 301*a* is a screen that is used in order for the user to enable or disable automatic switching of inserter trays. An ON key 302 is a software button for enabling automatic switching. The controller, upon detecting that the ON key 302 was operated, stores setting information indicating that automatic switching is enabled in the RAM 204. The CPU 203, when the inserter tray 117*a* runs out of sheets, switches the paper sheet feeding source to the inserter tray 117*b*, in accordance with the setting information, and continues feeding of sheets. An OFF key 303 is a software button for disabling automatic switching. The CPU 203, upon detecting that the OFF key 303 was operated, stores setting information indicating that automatic switching is disabled in the RAM 204. The CPU 203, when the inserter tray 117*a* runs out of sheets, temporarily stops feeding sheets, in accordance with the setting information. The CPU 203 resumes feeding of sheets, when the inserter tray 117*a* is replenished with sheets. An OK key 304 is a key for instructing the CPU 203 to enable the setting of this screen simultaneously with closing the screen.

Figure 3B:
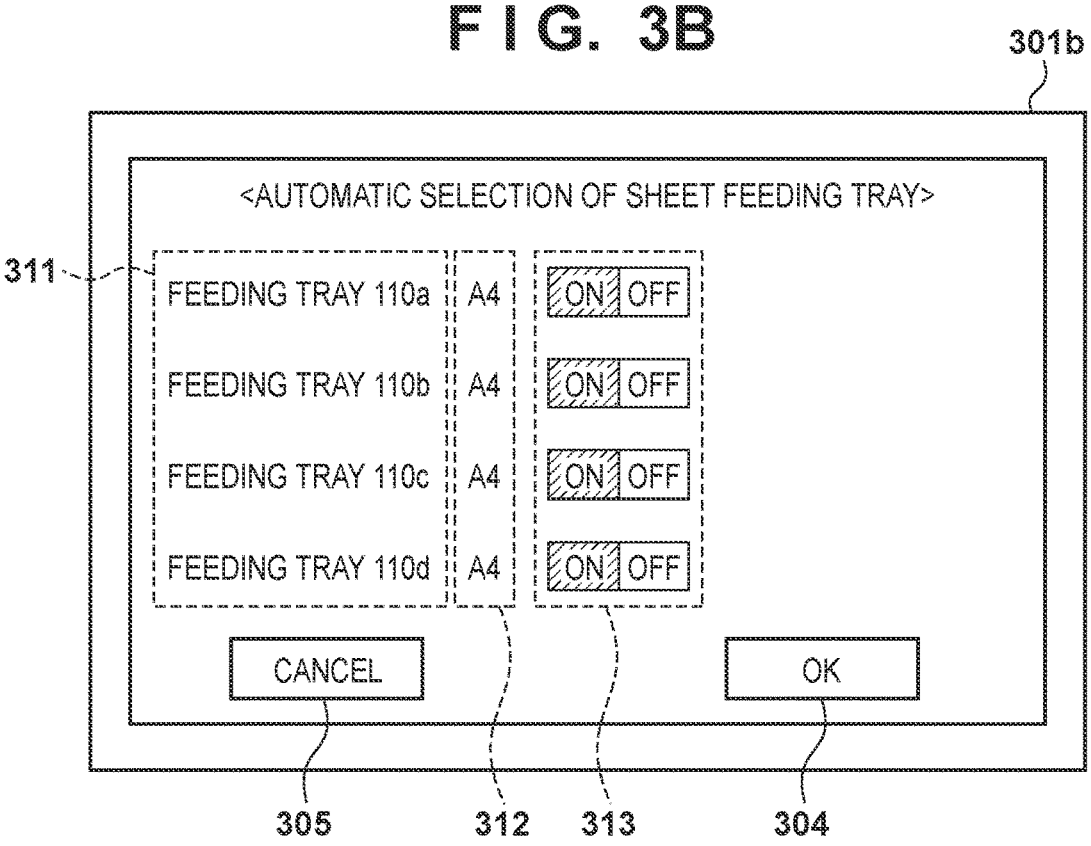

FIG. 3B shows a setting screen 301*b* for setting automatic switching of sheet feeding trays provided in the image forming apparatus 101. Automatic switching of sheet feeding trays means continuing to feed sheets when a given sheet feeding tray runs out of sheets, by switching the sheet feeding source from that sheet feeding tray to another sheet feeding tray. Automatic switching is executed in the case where sheets that are loaded in a given sheet feeding tray are the same as sheets that are loaded in another sheet feeding tray. For example, the sheet feeding trays 110*a* to 110*d* are assumed to each have a capacity of 500 sheets. In this case, automatic switching of the sheet feeding trays enables 2000 sheets to be continuously fed.

The CPU 203 displays the setting screen 301*b* on the display device of the operation unit 104. The setting screen 301*b* has a name display unit 311 that displays, for every sheet feeding tray, a name of the sheet feeding trays 110*a* to 110*d*. A size display unit 312 displays, for every sheet feeding tray, the size of the sheets. A switch unit 313 has, for every sheet feeding tray, an ON key and an OFF key for setting ON/OFF of automatic switching. The ON key and the OFF key may operate like a toggle switch. A cancel key 305 is a key for instructing the CPU 203 to cancel the setting change of this screen simultaneously with closing this screen.

For example, using the switch unit 313, the automatic switching mode of the sheet feeding trays 110*a* to 110*c* may be enabled, and the automatic switching mode of the sheet feeding tray 110*d* may be disabled. In this case, the CPU 203 feeds 1500 sheets continuously by switching between the sheet feeding trays 110*a* to 110*c*, but does not switch from the sheet feeding trays 110*a* to 110*c* to the sheet feeding tray 110*d*.

Figures 3C, 4:
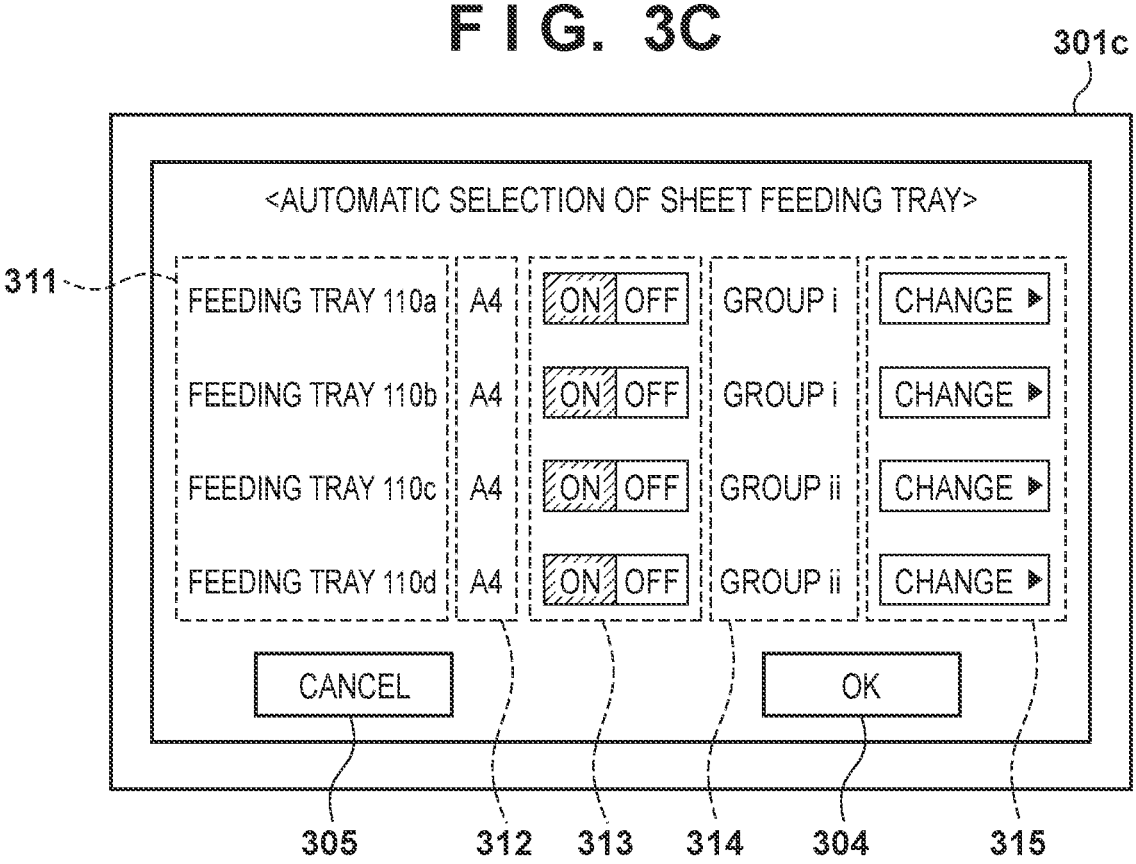
FIG. 4 is a diagram illustrating setting information.

FIG. 3C shows another illustrative setting screen 301*c* for setting automatic switching of the sheet feeding trays. On the setting screen 301*c*, a group display unit 314 and a group selection unit 315 are added to the setting screen 301*b*. The user performs grouping of the plurality of sheet feeding trays 110*a* to 110*d* according to the use application. For example, recording sheets (plain paper) may be loaded in the sheet feeding trays 110*a* and 110*b*, and heavy paper or insertion sheets may be loaded in the sheet feeding trays 110*c* and 110*d*.

Incidentally, the automatic switching mode may be enabled for all of the plurality of sheet feeding trays 110*a* to 110*d*. In this case, if heavy paper or insertion sheets are fed when the sheet feeding trays 110*a* and 110*b* are both empty, images will be recorded on sheets different from those intended by the user. Such sheets will be discarded. In particular, if it is discovered that images were recorded on sheets different from those intended by the user after bookbinding processing is executed in a post-processing apparatus, a large number of sheets will be wasted. Grouping the sheet feeding trays is effective in reducing the occurrence of such a situation.

The group display unit 314 displays the names of the groups to which the sheet feeding trays belong. The group selection unit 315 selects a group to which each sheet feeding tray should belong. For example, the group selection unit 315 may be a pull-down menu (drop-down list) that displays a list of groups from which one group is selectable.

The CPU 203 feeds sheets from the sheet feeding tray 110*b* belonging to group i when the sheet feeding tray 110*a* belonging to group i runs out of sheets. The CPU 203 feeds sheets from the sheet feeding tray 110*d* belonging to group ii when the sheet feeding tray 110*c* belonging to group ii runs out of sheets. Note that when the sheet feeding trays 110*a* and 110*b* belonging to group i both run out of sheets, the CPU 203 temporarily stops the print job and waits for sheets to be replenished. In other words, the CPU 203 does not feed sheets from the sheet feeding trays 110*c* and 110*d* belonging to group ii, even when the sheet feeding trays 110*a* and 110*b* belonging to group i both run out of sheets.

FIG. 4 shows part of the setting information that is stored in the RAM 204 by the CPU 203. In this example, the size and type of sheets that are loaded in each of the sheet feeding trays 110*a* to 110*d* and the inserter trays 117*a* and 117*b* are shown. Preprinted sheets are sheets on which images are formed in advance, before being loaded in the sheet feeding trays 110 or the inserter trays 117.

Figure 5:
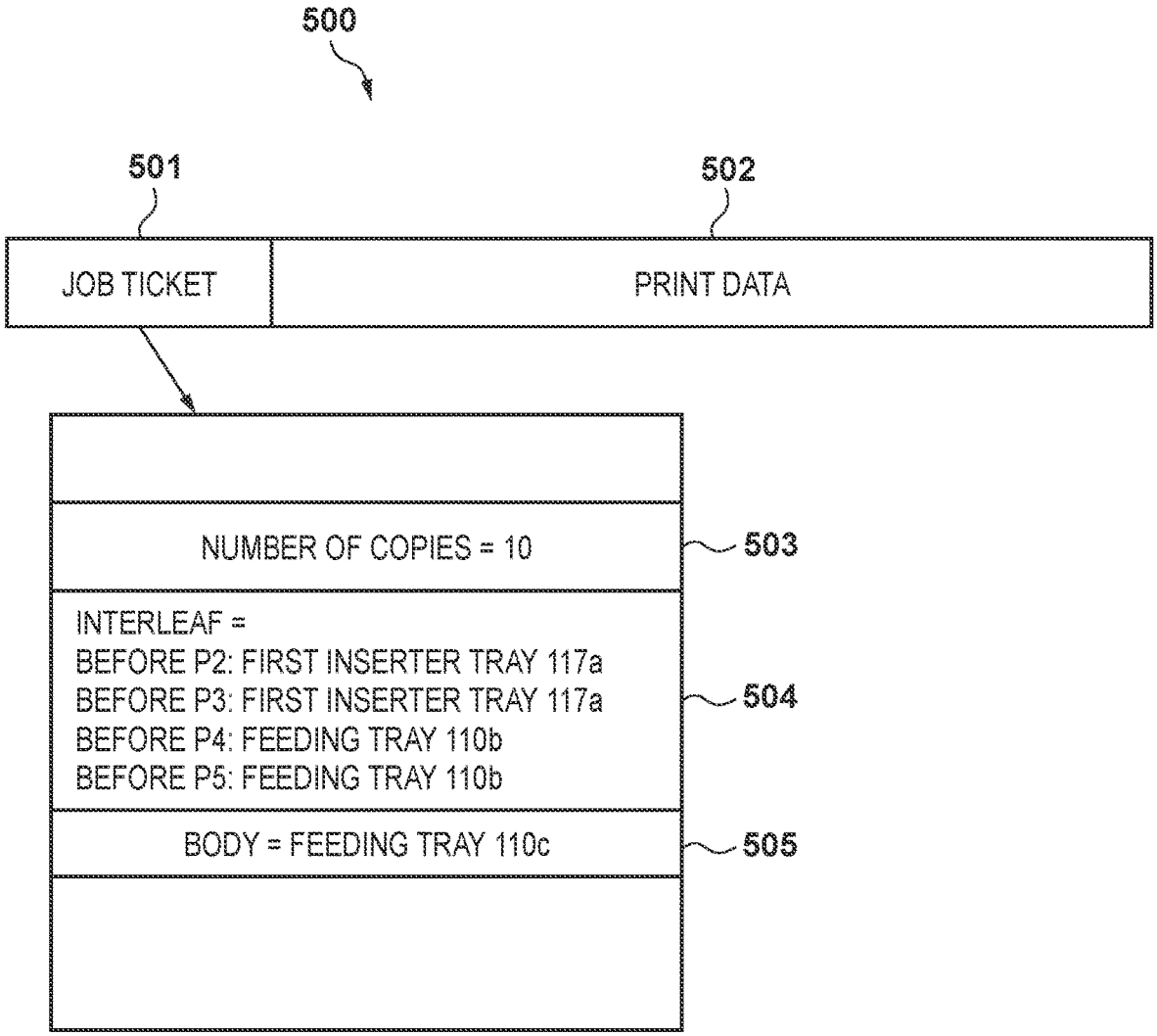
FIG. 5 is a diagram illustrating job data.

FIG. 5 shows example job settings. Job data 500 that is received by the communication circuit 206 has a job ticket 501 and print data 502. The job ticket 501 includes setting information for setting duplex printing/simplex printing, staple yes/no, insertion sheet yes/no, and the like. It is assumed that insertion sheet is set to interleaf sheet as an example, but insertion sheet may be set to front cover sheet, back cover sheet, chapter sheet, or the like. The print data 502 is data for specifying the image to be printed, such as PDL data, for example. PDL is the abbreviation for page description language.

The job ticket 501 may further have number-of-copies information 503, insertion sheet information 504, and main body information 505. The number-of-copies information 503 is information designating the number of printed copies. For example, "10" is stored in the number-of-copies information 503 in the case of printing 10 copies of a main body consisting of 150 pages. The insertion sheet information 504 includes information indicating the insert positions of insertion sheets and the sheet feeding source of the insertion sheets. For example, "before P2: first inserter tray" means that an interleaf sheet fed from the inserter tray 117*a* is to be inserted before the second page of the main body. The main body information 505 includes information indicating the sheet feeding source (e.g.: sheet feeding tray 110*c*) of the sheets (recording sheets) on which the main body is to be printed. The print data 502 may have attribute information for every page, instead of the job ticket 501. Attribute information includes information designating the sheet feeding source for every page.

Figure 6A:
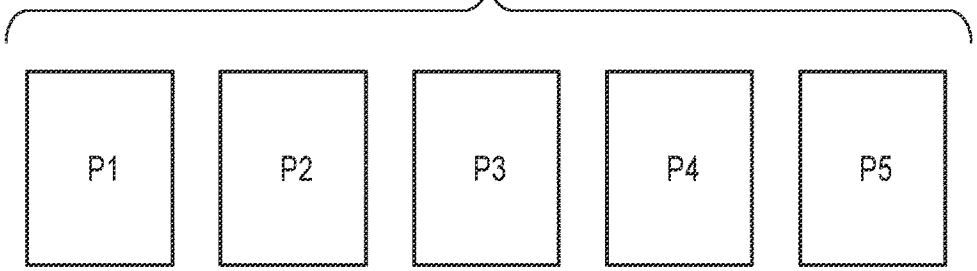
FIGS. 6A to 6C are diagrams illustrating an output result of a job.
Figure 6B:
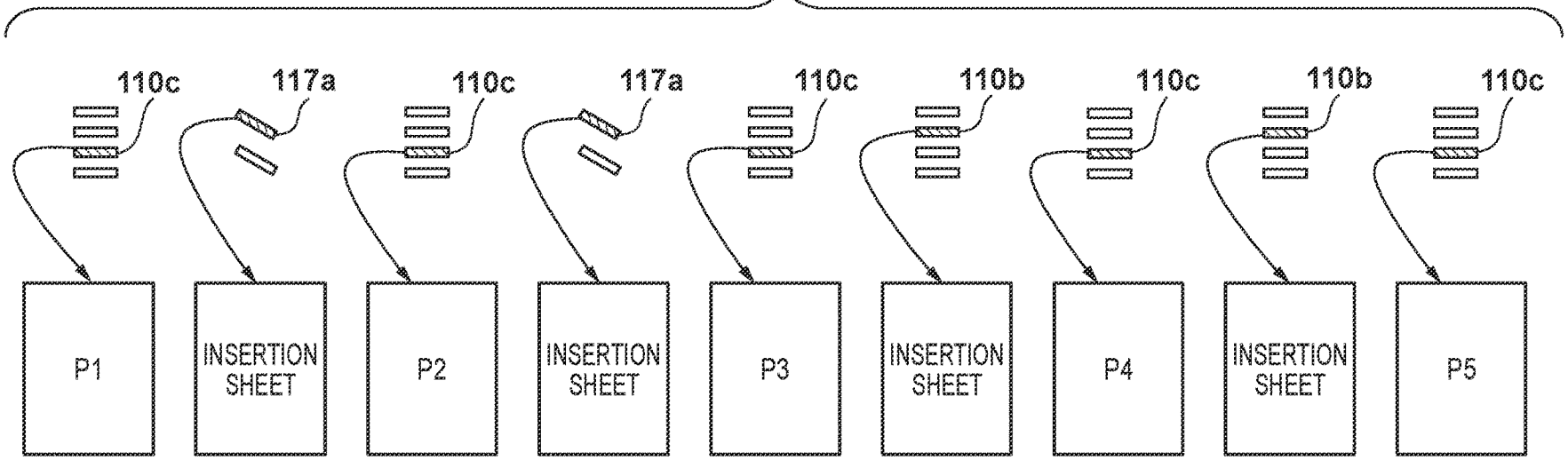

FIG. 6A shows the output result of a print job including a main body that consists of 5 pages. The print data 502 has 5 pages of image data in PDL format. FIG. 6B shows the relationship between each sheet and the sheet feeding source in the case where the sheet feeding source designated by the job data 500 shown in FIG. 5 does not run short of sheets. The pages from the first sheet P1 to the fifth sheet P5 are all fed from the sheet feeding tray 110*c*. An insertion sheet is fed from the inserter tray 117*a* before both sheet P2 and sheet P3. An insertion sheet is fed from the sheet feeding tray 110*b* before both sheet P4 and sheet P5.

Figure 6C:
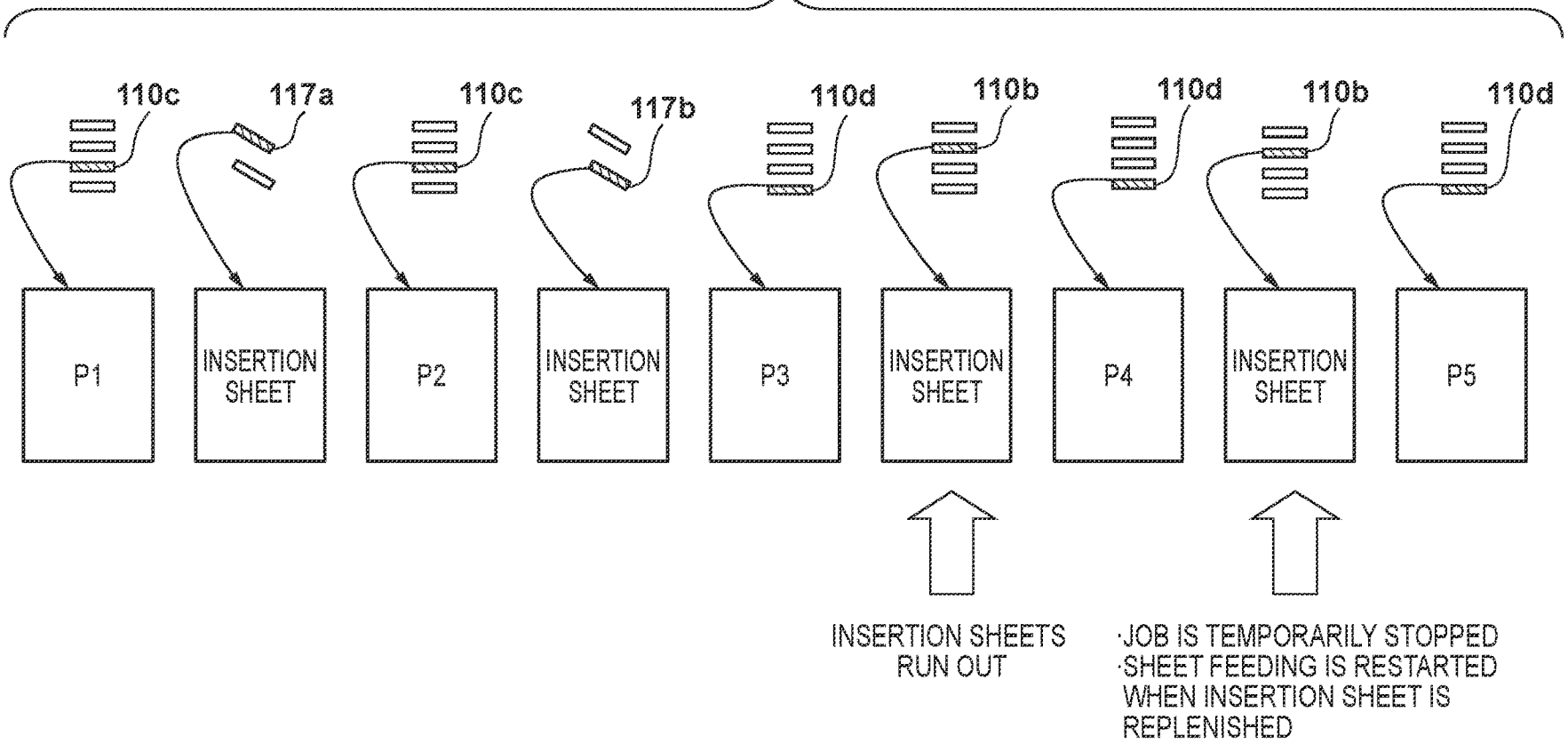

FIG. 6C shows the relationship between each sheet and the sheet feeding source in the case where in the sheet feeding source designated by the job data 500 runs short of sheets. In this example, the CPU 203 detects that the inserter tray 117*a* that fed insertion sheets before both sheet P2 and sheet P3 has run out of sheets, using the sheet sensor 119*a*, after supplying the insertion sheet inserted before P2. As such, the CPU 203 switches the sheet feeding source of insertion sheets from the inserter tray 117*a* to the inserter tray 117*b*. This is because the automatic switching mode of the inserter trays is enabled on the setting screen 301*a*. The inserter tray 117*b* thereby inserts an insertion sheet before sheet P3.

The CPU 203 detects that the sheet feeding tray 110*c* that fed sheet P2 has run out of sheets, using the sheet sensor 120*c*. On the setting screen 301*c*, the sheet feeding tray 110*c* and the sheet feeding tray 110*d* are allocated to group ii. As such, the CPU 203 switches the sheet feeding source of sheets from the sheet feeding tray 110*c* to the sheet feeding tray 110*d*. In other words, the sheet feeding tray 110*d* supplies sheets P3 and P4.

Incidentally, the CPU 203 detects that the sheet feeding tray 110*b* has run out of insertion sheets, using the sheet sensor 120*b*. This occurs when an insertion sheet has been inserted before sheet P4. However, the CPU 203 prohibits switching the sheet feeding source of insertion sheets from the sheet feeding tray 110*b* to another sheet feeding tray 110, and temporarily stops the job. The CPU 203 resumes feeding of insertion sheets from the sheet feeding tray 110*b*, upon detecting that the sheet feeding tray 110*b* has been replenished with insertion sheets, using the sheet sensor 120*b*. In other words, an insertion sheet fed from the sheet feeding tray 110*b* is inserted before sheet P5.

Flowcharts

Figure 7:
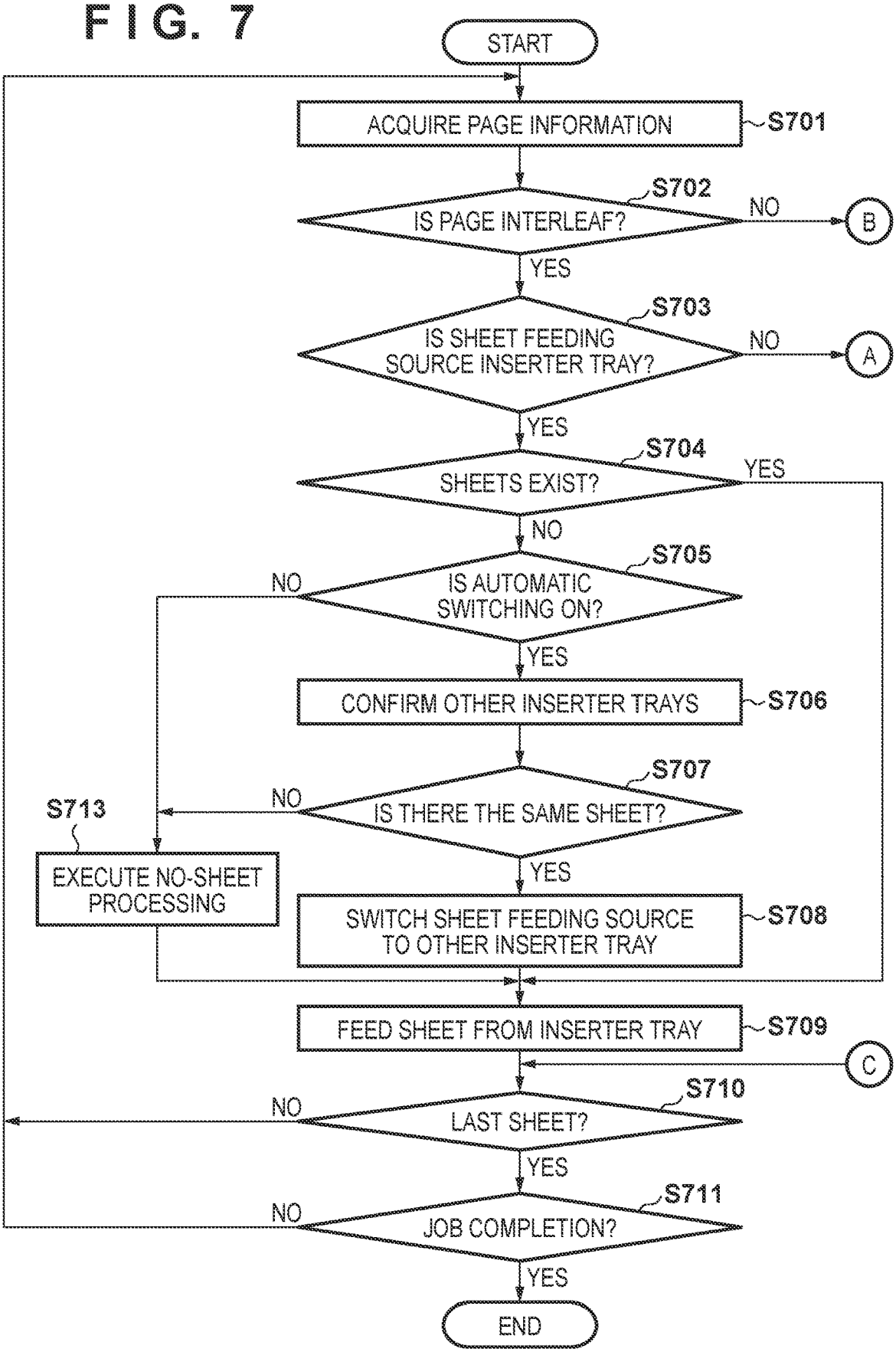
FIG. 7 is a flowchart illustrating image forming processing.
Figure 8:
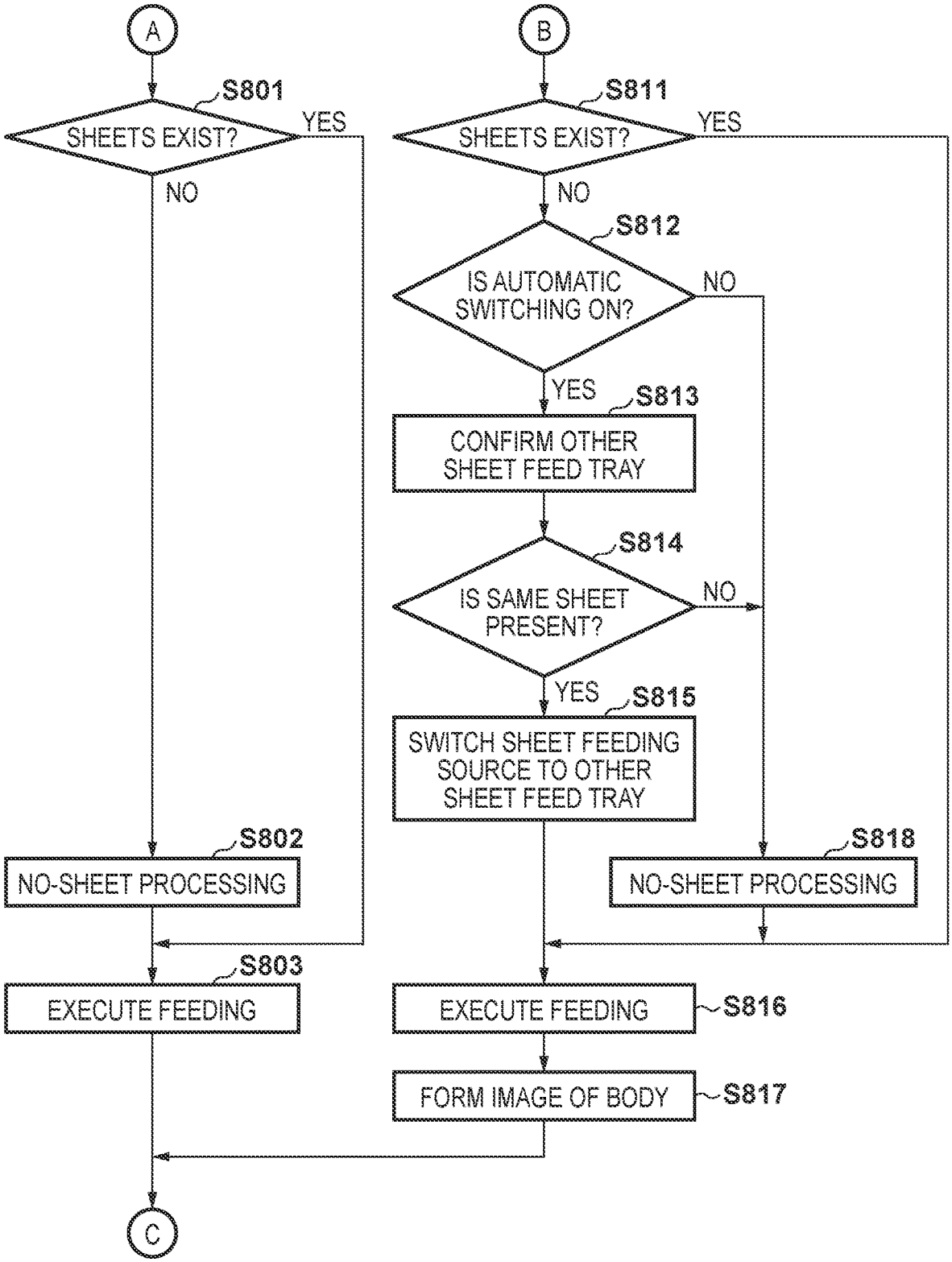
FIG. 8 is a flowchart illustrating image forming processing.

FIGS. 7 and 8 are flowcharts showing image forming processing.

Here, for convenience of description, the insertion sheets are assumed to be interleaf sheets.

The page information that the CPU 203 acquires in step S701 from the job data 500 that is stored in the RAM 204 is the insertion sheet information 504 and the main body information 505, out of the information that is included in the job ticket 501.

In step S702, the CPU 203 determines whether the page to be processed is an interleaf sheet based on the page information. Here, "page" includes not only pages of the main body but also interleaf sheets. In other words, "page" means the respective sheets constituting one copy. The CPU 203 manages the pages with page number i. For example, in the job illustrated in FIG. 5, it is clear that if the page number i of the page to be processed is 1, this corresponds to page P1 of the main body. Also, it is clear that when page number i is 2, this corresponds to an interleaf sheet that is supplied from the first inserter tray. If the page is an interleaf sheet, the CPU 203 advances the processing to step S703. If the page is not an interleaf sheet, the CPU 203 advances the processing to step S811.

In step S703, the CPU 203 determines whether the sheet feeding source of the interleaf sheet is an inserter tray 117 based on the page information. The sheet feeding source is designated by the insertion sheet information 504 of the page information. If the sheet feeding source is an inserter tray 117, the CPU 203 advances the processing to step S704. If the sheet feeding source is not an inserter tray 117, the CPU 203 advances the processing to step S801.

In step S704, the CPU 203 determines whether sheets exist in the inserter tray 117 designated as the sheet feeding source based on the detection result of a sheet sensor 119. For example, if the sheet feeding source is the inserter tray 117*a*, the CPU 203 determines whether sheets exist in the inserter tray 117*a*, based on the detection result of the sheet sensor 119*a*. If sheets exist, the CPU 203 advances the processing to step S709. If sheets do not exist, the CPU 203 advances the processing to step S705.

In step S705, the CPU 203 determines whether the automatic switching mode is set to ON for the inserter trays 117, based on the setting information that is held in the RAM 204. The setting information is created in advance using the setting screen 301*a* shown in FIG. 3A, and held in the RAM 204. If the automatic switching mode is ON, the CPU 203 advances the processing to step S706. If the automatic switching mode is OFF, the CPU 203 advances the processing to step S713. In step S713, the CPU 203 executes no-sheet processing. For example, the CPU 203 temporarily stops the job and displays a message prompting to replenish interleaf sheets on the display device of the operation unit 104. Furthermore, the CPU 203 determines whether the inserter tray 117*a* designated as the sheet feeding source has been replenished with sheets based on the detection result of the sheet sensor 119*a*. When the inserter tray 117*a* is replenished with sheets, the CPU 203 resumes the job and advances the processing to step S709.

In step S706, the CPU 203 checks for other inserter trays 117 that are not designated as the sheet feeding source. For example, the CPU 203 recognizes that the inserter 102 is provided with the inserter trays 117*a* and 117*b* based on specification information on the inserter 102 that is stored in the ROM 208. Furthermore, the CPU 203 specifies the inserter tray 117*b* as an inserter tray 117 that is not designated as the sheet feeding source, based on the insertion sheet information 504. The CPU 203 acquires the detection result of the sheet sensor 119*b* corresponding to the inserter tray 117*b*.

Generally, the interleaf sheets that are loaded in the sheet feeding trays 110 often differ from the interleaf sheets loaded in the inserter trays 117. Accordingly, when the inserter trays 117 run out of interleaf sheets, interleaf sheets different from those intended by the user will be fed if interleaf sheets are fed from the sheet feeding trays 110. As such, in step S706, the sheet feeding trays 110 are not treated as sheet feeding source candidates. Thus, the sheet feeding source of the interleaf sheets is not switched from the inserter trays 117 to the sheet feeding trays 110.

In step S707, the CPU 203 determines whether the same sheets as the sheets of the inserter tray 117 designated as the sheet feeding source are in other inserter trays 117. The CPU 203 determines whether there are sheets in the inserter tray 117*b* based on the detection result of the sheet sensor 119*b*. In the case where there are sheets in the inserter tray 117*b*, the CPU 203 acquires the setting information shown in FIG. 4 from the RAM 204. The CPU 203 determines whether the size and type of sheets that are loaded in the inserter tray 117*b* match the size and type of sheets that are loaded in the inserter tray 117*a*, based on the setting information. In other words, it is determined whether the inserter trays 117*a* and 117*b* are loaded with the same interleaf sheets. If the same sheets are not in another inserter tray 117, the CPU 203 advances the processing to step S713. If the same sheets are in another inserter tray 117, the CPU 203 advances the processing to step S708.

In step S708, the CPU 203 switches the sheet feeding source to the other inserter tray 117. For example, the CPU 203 rewrites information indicating the sheet feeding source of interleaf sheets in the insertion sheet information 504 from the inserter tray 117*a* to the inserter tray 117*b*.

In step S709, the CPU 203 controls the inserter tray 117 designated as the sheet feeding source, and feeds sheets from the inserter tray 117. A sheet feeding roller and a motor for driving the sheet feeding roller are provided in each tray. The CPU 203 feeds sheets by driving this motor.

In step S710, the CPU 203 determines whether processing (image forming and insert processing) of the last sheet has been completed, based on the job data 500. If the processed sheet is the last sheet constituting one copy, the CPU 203 advances the processing to step S711. If not the last sheet, the CPU 203 advances the processing to step S701, in order to process the next sheet.

In step S711, the CPU 203 determines whether the job has been completed, based on the job data 500. For example, the CPU 203 determines whether processing of all the copies designated by the job data 500 has been completed. For example, if the number of copies is 300, the CPU 203 determines whether 300 copies have been created.

Case where the Page is not an Interleaf Sheet

Steps S811 to S817 of FIG. 8 show processing that is executed in the case where the page is not an interleaf sheet. In step S811, the CPU 203 determines whether there are sheets in the sheet feeding tray 110 designated as the sheet feeding source, based on the job data 500 and the detection result of a sheet sensor 120. For example, the CPU 203 specifies that the sheet feeding tray 110 designated as the sheet feeding source is the sheet feeding tray 110*c*, based on the main body information 505. The CPU 203 determines whether there are sheets in the sheet feeding tray 110*c* based on the detection result of the sheet sensor 120*c*. If there are sheets in the sheet feeding source, the CPU 203 advances the processing to step S816. If there are not sheets in the sheet feeding source, the CPU 203 advances the processing to step S812.

In step S812, the CPU 203 determines whether the automatic switching mode of the sheet feeding tray 110 is ON, based on the setting information that is held in the RAM 204. The setting information is created in advance via the setting screen 301*b* or 301*c*, and held in the RAM 204. If the automatic switching mode is ON, the CPU 203 advances the processing to step S813. If the automatic switching mode is not ON, the CPU 203 advances the processing to step S818. In step S818, the CPU 203 executes no-sheet processing. For example, the CPU 203 temporarily stops the job and displays a message prompting to replenish sheets on the display device of the operation unit 104. Furthermore, the CPU 203 determines whether the sheet feeding tray 110*c* designated as the sheet feeding source has been replenished with sheets based on the detection result of the sheet sensor 120*c*. When the sheet feeding tray 110*c* is replenished with sheets, the CPU 203 resumes the job and advances the processing to step S816.

In step S813, the CPU 203 checks for other sheet feeding trays 110 that are not designated as the sheet feeding source. For example, the CPU 203 specifies group ii to which the sheet feeding tray 110*c* designated as the sheet feeding source belongs, based on the setting information set through the setting screen 301*c* of FIG. 3C. Furthermore, the CPU 203 specifies the other sheet feeding tray 110*d* belonging to the specified group ii, based on this setting information. The CPU 203 acquires the detection result of the sheet sensor 120*d* corresponding to the sheet feeding tray 110*d*.

In step S814, the CPU 203 determines whether the same sheets as the sheets of the sheet feeding tray 110 designated as the sheet feeding source are in another sheet feeding tray 110. The CPU 203 determines whether there are sheets in the other sheet feeding tray 110*d* based on the detection result of the sheet sensor 120*d*. In the case where there are sheets in the sheet feeding tray 110*d*, the CPU 203 acquires the setting information shown in FIG. 4 from the RAM 204. The CPU 203 determines whether the size and type of sheets that are loaded in the sheet feeding tray 110*d* match the size and type of sheets that are loaded in the sheet feeding tray 110*c*, based on the setting information. In other words, it is determined whether the sheet feeding trays 110*c* and 110*d* are loaded with the same sheets (e.g.: plain paper). If the same sheets are not in the other sheet feeding tray 110*d*, the CPU 203 advances the processing to step S818. If the same sheets are in the other sheet feeding tray 110*d*, the CPU 203 advances the processing to step S815.

In step S815, the CPU 203 switches the sheet feeding source to the other sheet feeding tray 110. For example, the CPU 203 rewrites information indicating the sheet feeding source of the sheets in the main body information 505 from the sheet feeding tray 110*c* to the sheet feeding tray 110*d*.

In step S816, the CPU 203 controls the sheet feeding tray 110 designated as the sheet feeding source, and feeds a sheet from the sheet feeding tray 110. In step S817, the CPU 203 controls the image forming apparatus 101, and forms an image of the main body on the sheet. Thereafter, the CPU 203 advances the processing to step S710.

Case where the Sheet Feeding Source of Interleaf Sheets is a Sheet Feeding Tray

Steps S801 to S803 shown in FIG. 8 show the case where the sheet feeding source of interleaf sheets is a sheet feeding tray. The sheet feeding trays 110*a* and 110*b* are both capable of feeding preprinted sheets. However, the insertion sheets (e.g.: interleaf sheets) loaded in the sheet feeding tray 110*a* often differ from the insertion sheets (e.g.: chapter sheets) loaded in the sheet feeding tray 110*b*. As such, the CPU 203 prohibits switching of the sheet feeding source between the sheet feeding trays 110*a* and 110*b* that are respectively loaded with insertion sheets.

In step S801, the CPU 203 determines whether there are sheets in the sheet feeding tray 110 designated as the sheet feeding source, based on the job data 500 and the detection result of a sheet sensor 120. For example, the CPU 203 specifies that the sheet feeding tray 110 designated as the sheet feeding source is the sheet feeding tray 110*b*, based on the insertion sheet information 504. The CPU 203 determines whether there are sheets in the sheet feeding tray 110*b* based on the detection result of the sheet sensor 120*b*. If there are sheets in the sheet feeding source, the CPU 203 advances the processing to step S803. If there are not sheets in the sheet feeding source, the CPU 203 advances the processing to step S802.

In step S802, the CPU 203 executes no-sheet processing. For example, the CPU 203 temporarily stops the job and displays a message prompting to replenish sheets on the display device of the operation unit 104. Furthermore, the CPU 203 determines whether the sheet feeding tray 110*b* designated as the sheet feeding source has been replenished with sheets based on the detection result of the sheet sensor 120*b*. When the sheet feeding tray 110*b* is replenished with sheets, the CPU 203 resumes the job and advances the processing to step S803.

In step S803, the CPU 203 feeds a sheet from the sheet feeding tray 110 designated as the sheet feeding source. In this way, in the case where the sheet feeding source of interleaf sheets is a sheet feeding tray, automatic switching of the sheet feeding trays is not executed, even if the automatic switching mode is ON. Therefore, erroneous feeding of interleaf sheets tends not to occur.

In Summary

The sheet feeding trays 110*a* to 110*d* as shown in FIG. 1 are examples of a first sheet feeding tray and a second sheet feeding tray capable of loading a plurality of sheets. The image forming unit 106 is an example of an image forming unit that is disposed downstream from the first sheet feeding tray (e.g.: sheet feeding tray 110*c*) and the second sheet feeding tray (e.g.: sheet feeding tray 110*b*) in the sheet conveyance direction. Furthermore, the image forming unit 106 forms images on sheets that are fed from the first sheet feeding tray or the second sheet feeding tray. Note that the image forming unit 106 need not form images on insertion sheets that are fed from the second sheet feeding tray. The inserter trays 117*a* and 117*b* are examples of a first inserter tray and a second inserter tray provided downstream from the image forming unit in the sheet conveyance direction. The inserter trays 117*a* and 117*b* are capable of loading a plurality of sheets. The controller 103 and the CPU 203 each function as a control unit. Note that the insertion sheets are sheets that are inserted before or after the sheets on which an image is formed by the image forming unit. In other words, the insertion sheets are sheets that are inserted between a plurality of sheets on which an image is formed by the image forming unit. The insertion sheets may be supplied from any sheet feeding tray and any inserter tray. The sheet feeding trays and the inserter trays may be referred to as loading units. A job may be received in which the sheet feeding source of insertion sheets to be inserted between a plurality of sheets on which an image is formed by the image forming unit is set to the first inserter tray. As shown in FIG. 7, in the case where the sheets that are loaded in the first inserter tray run out during execution of the job, the CPU 203 switches the sheet feeding source from the first inserter tray to the second inserter tray and continues execution of the job. A job may be received in which the sheet feeding source of insertion sheets to be inserted between a plurality of sheets on which an image is formed by the image forming unit is set to the second sheet feeding tray. As shown in FIG. 8, the CPU 203 does not switch from the second sheet feeding tray to another tray, in the case where the sheets that are loaded in the second sheet feeding tray run out during execution of the job. Furthermore, the CPU 203 temporarily stops execution of the job. The occurrence of sheets different from those intended being inserted before or after recording sheets is thereby reduced.

The operation unit 104 and the setting screen 301 are each an example of a setting unit that sets the automatic switching mode of the sheet feeding source of sheets to enabled or disabled. There are cases where sheets that are loaded in the first inserter tray run out during execution of a job in which the automatic switching mode is set to enabled and the sheet feeding source of insertion sheets is set to the first inserter tray. The CPU 203, in this case, may switch from the first inserter tray to the second inserter tray and continue execution of the job. There are cases where sheets that are loaded in the first inserter tray run out during execution of a job in which the automatic switching mode is set to disabled and the sheet feeding source of insertion sheets is set to the first inserter tray. The CPU 203, in this case, may temporarily stop execution of the job without switching from the first inserter tray to the second inserter tray. In this way, in relation to the inserter trays, automatic switching of the sheet feeding source is executed in accordance with ON/OFF of the automatic switching mode.

Therefore, interruption of jobs resulting from lack of insertion sheets tends not to occur.

Sheets that are loaded in the second sheet feeding tray may run out during execution of a job in which the sheet feeding source of insertion sheets is set to the second sheet feeding tray. In this case, the CPU 203 temporarily stops execution of the job without switching from the second sheet feeding tray to another tray, independently of whether the automatic switching mode is set to enabled or is set to disabled. Erroneous feeding of insertion sheets will thereby be unlikely to occur.

There are cases where the sheets that are loaded in the first inserter tray run out during execution of a job in which the sheet feeding source of insertion sheets is set to the first inserter tray. In this case, the CPU 203 may function as a determination unit that determines whether the second inserter tray is loaded with the same type of sheets as the sheets that are loaded in the first inserter tray. There are cases where the sheets that are loaded in the first inserter tray run out during execution of a job in which the sheet feeding source of insertion sheets is set to the first inserter tray, and the second inserter tray is loaded with the same type of sheets as the sheet that are loaded in the first inserter tray. In this case, the CPU 203 may switch from the first inserter tray to the second inserter tray and continue execution of the job. There are cases where the sheets that are loaded in the first inserter tray run out during execution of a job in which the sheet feeding source of insertion sheets is set to the first inserter tray, and the second inserter tray is not loaded with the same type of sheets as the sheets that are loaded in the first inserter tray. In this case, the CPU 203 may temporarily stop execution of the job without switching from the first inserter tray to the second inserter tray.

The setting screen 301*c* allocates groups to the sheet feeding trays, but the setting screen 301*c* may be changed to allocate groups to the inserter trays. The CPU 203 may function as an allocation unit that allocates the first inserter tray and the second inserter tray to the same group. The CPU 203 may determine that the second inserter tray is loaded with the same type of sheets as the sheets that are loaded in the first inserter tray, in the case where the first inserter tray and the second inserter tray are allocated to the same group. There are cases where the determination unit determines that the first inserter tray and the second inserter tray are not allocated to the same group, when the sheets that are loaded in the first inserter tray run out during execution of a job in which the sheet feeding source of insertion sheets is set to the first inserter tray. In this case, the CPU 203 may temporarily stop the job without switching from the first inserter tray to the second inserter tray.

As shown in FIG. 1, the sheet feeding tray 110*a* is an example of a third sheet feeding tray provided upstream from the image forming unit in the sheet conveyance direction and capable of loading sheets. As shown in FIG. 4, the second sheet feeding tray (e.g.: sheet feeding tray 110*b*) and the third sheet feeding tray (e.g.: sheet feeding tray 110*a*) may be designated in advance to each load sheets that serve as insertion sheets. The CPU 203 may, in the case where the sheets that are loaded in the second sheet feeding tray run out during execution of a job in which the sheet feeding source of insertion sheets is set to the second sheet feeding tray, temporarily stop execution of the job without switching from the second sheet feeding tray to the third sheet feeding tray. Erroneous feeding of insertion sheets thereby tends not to occur.

The sheet feeding tray 110*d* is an example of a fourth sheet feeding tray provided upstream from the image forming unit in the sheet conveyance direction and capable of loading sheets. As shown in FIG. 4, the first sheet feeding tray (e.g.: sheet feeding tray 110*c*) and the fourth sheet feeding tray (e.g.: sheet feeding tray 110*d*) may be designated in advance to each load sheets on which an image is to be formed by the image forming unit. The CPU 203, in the case where the automatic switching mode is set to enabled, switches from the first sheet feeding tray to the fourth sheet feeding tray and continues execution of the job, if the sheets that are loaded in the first sheet feeding tray run out. The CPU 203, in the case where the automatic switching mode is set to disabled, temporarily stops the job without switching from the first sheet feeding tray to the fourth sheet feeding tray, if the sheets that are loaded in the first sheet feeding tray run out.

As shown in FIG. 1, the first sheet feeding tray, the second sheet feeding tray and the image forming unit may be provided in the image forming apparatus 101. Note that the first sheet feeding tray and the second sheet feeding tray may be manual sheet feeding trays, or may be sheet feeding devices that are connected to the image forming apparatus 101. The first inserter tray and the second inserter tray may be provided in the inserter 102. The first inserter tray and the second inserter tray may also be provided in a finisher having an insert function.

The switch unit 313 is an example of a setting unit for setting, for every tray, automatic switching of the tray to enabled or disabled. The group selection unit 315 is an example of a selection unit that selects a group for every tray. The operation unit 104 is an example of a display unit that displays a user interface (e.g.: setting screen 301*c*).

The CPU 203 and the operation unit 104 may each function as a designation unit that designates, for every tray, the size of sheets to be loaded, and a type (sheet type) indicating that the sheets are one of recording sheets or insertion sheets. The CPU 203 may determine that the sheets are the same, if the size is the same and the type is the same. The insertion sheets may be any of a front cover sheet, a back cover sheet, an interleaf sheet, and a chapter sheet.

Figure 9:
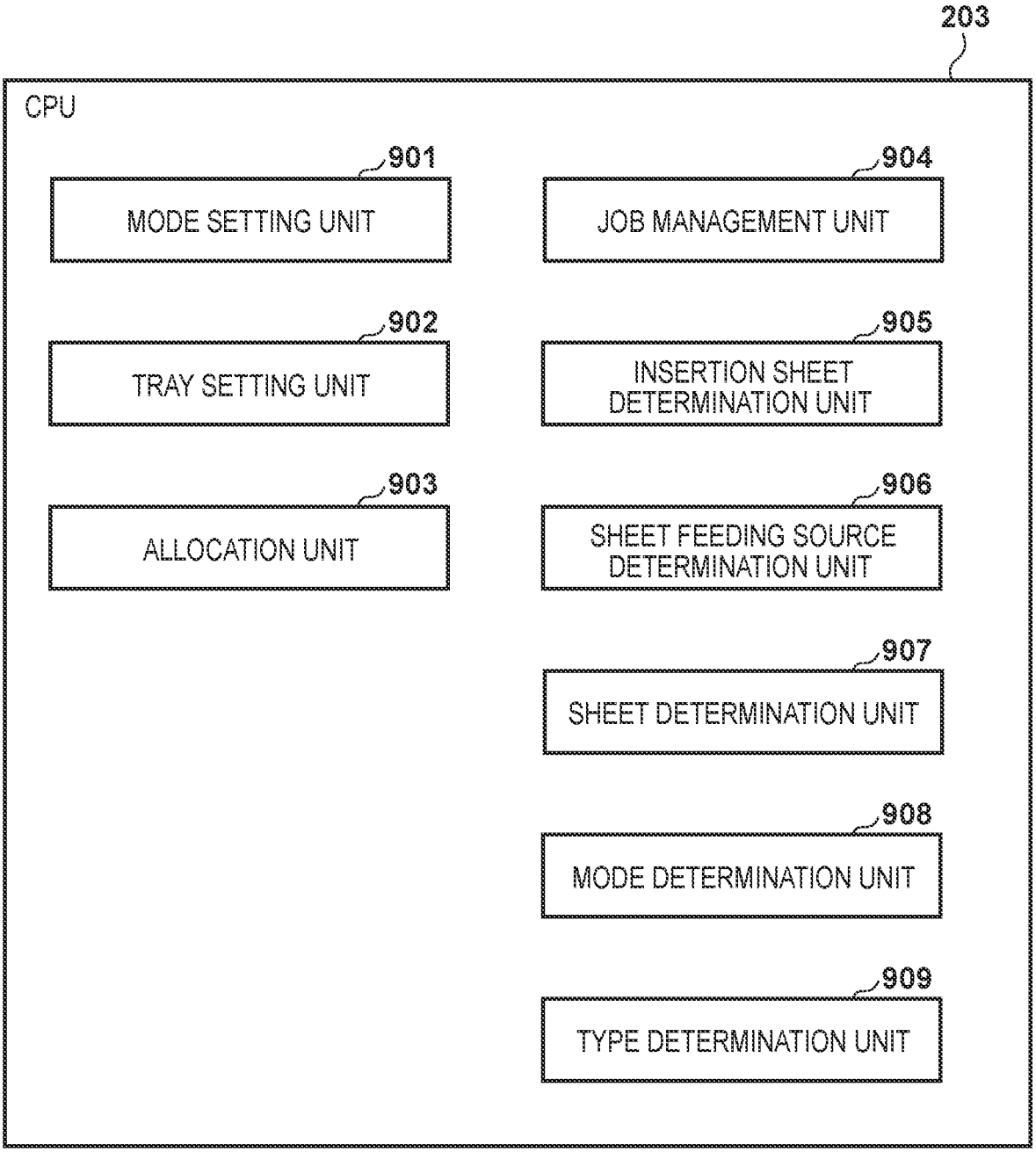
FIG. 9 is a diagram illustrating functions of a control unit.

FIG. 9 shows a plurality of functions that are realized by the CPU 203 executing a control program. Some or all of these functions may be realized by a hardware circuit such as an ASIC or FPGA. A mode setting unit 901 displays the setting screens 301*a* to 301*c* on the operation unit 104, sets ON/OFF of the automatic switching mode based on user inputs, and writes setting information to the RAM 204. User inputs are input through the ON key 302, the OFF key 303, and the switch unit 313. A tray setting unit 902 sets the size and type of sheets to be loaded in the sheet feeding trays 110 and the inserter trays 117 in accordance with user inputs, and writes setting information to the RAM 204. The allocation unit 903 allocates groups to the sheet feeding trays 110 and the inserter trays 117, in accordance with user inputs that are input through the group selection unit 315, and writes setting information to the RAM 204.

A job management unit 904 analyzes the job data 500, and manages the position and sheet feeding source of pages of the main body and insertion sheets. The job management unit 904 controls execution of jobs, based on the job data 500. The job management unit 904 determines in step S710 whether the last sheet has been processed, and determines in step S711 whether the job is completed, based on the job data 500.

An insertion sheet determination unit 905, in step S702 and the like, determines whether the page to be processed is an insertion sheet or a recording sheet. A sheet feeding source determination unit 906, in step S703 and the like, determines the sheet feeding source of insertion sheets and recording sheets, based on the job data 500 and setting information. A sheet determination unit 907, in steps S704, S706, S811, S813 and the like, determines whether there are sheets in respective trays, based on the detection results of the sheet sensors 119 and 120. A mode determination unit 908, in steps S705, S812 and the like, determines ON/OFF of the automatic switching mode for respective trays based on the setting information created by the mode setting unit 901. A type determination unit 909, in steps S807, S814 and the like, determines the size and type of sheets that are loaded in respective trays based on the setting information created by the tray setting unit 902.

The disclosure is not limited to the above embodiments, and various changes and modifications can be made within the spirit and scope of the disclosure. Therefore, the following claims are appended to apprise the public of the scope of the disclosure.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-235908, filed on Dec. 17, 2018 which is hereby incorporated by reference herein in its entirety.

What is claimed is:

1. An image forming system comprising:

a plurality of sheet feeding trays capable of storing a plurality of sheets, the plurality of sheet feeding trays including a first sheet feeding tray capable of storing insertion sheets, a second sheet feeding tray capable of storing insertion sheets or recording sheets, and a third sheet feeding tray capable of storing recording sheets;

a first sheet sensor configured to detect a sheet stored on the first sheet feeding tray;

an image formation unit configured to form an image on a sheet fed from the third sheet feeding tray;

a plurality of inserter trays provided downstream of the image forming unit in a sheet conveyance direction and capable of loading a plurality of sheets, the plurality of inserter trays including a first inserter tray capable of storing insertion sheets and a second inserter tray capable of storing insertion sheets;

a second sheet sensor configured to detect a sheet stored on the first inserter tray;

an insertion unit configured to insert an insertion sheet fed from one of the plurality of inserter trays between sheets conveyed from the image formation unit; and a control unit configured to accept a job, and control, according to the job, the image formation unit and the insertion unit to form images on a first recording sheet and a second recording sheet and insert an insertion sheet on which an image is not formed between the first recording sheet and the second recording sheet, wherein in a case (a) where: the job designates that the insertion sheet is fed from the first inserter tray; the second sheet sensor has detected that there is no insertion sheet on the first inserter tray; and the second inserter tray stores a sheet of which type and size are same as those of the sheets running out on the first inserter trays, the control unit controls the insertion unit to feed the sheet as the insertion sheet from the second inserter tray, and continues the job, and wherein in a case (b) where: the job designates that the insertion sheet is fed from the first sheet feeding tray; the first sheet sensor has detected that there is no insertion sheet on the first sheet feeding tray; and the second sheet feeding tray stores a sheet of which type and size are same as those of the sheets running out on the first sheet feeding tray, the control unit controls the image formation unit not to feed the sheet as the insertion sheet from the second sheet feeding tray, and temporarily stops the job, and after insertion sheets are replenished in the first sheet feeding tray, the control unit resumes the job to feed one of the replenished sheets from the first sheet feeding tray.

2. The image forming system according to claim 1, further comprising:

a setting unit configured to set an automatic switching mode of the plurality of inserter trays to enabled or disabled, wherein the control unit is configured to, in a case where the automatic switching mode is set to enabled and one of the plurality of inserter trays runs out of sheets, control the insertion unit such that a sheet of which type and size are same as those of the sheets running out on the one of the plurality of inserter trays is fed from the another one of the plurality of inserter trays, as the insertion sheet, and continue the job, and is configured to, in a case where the automatic switching mode is set to disabled, and the one of the plurality of inserter trays runs out of sheets, control the insertion unit such that a sheet of which type and size are same as those of the sheets running out on the one of the plurality of inserter trays is not fed from the another one of the plurality of inserter trays, and stop temporarily the job.

3. The image forming system according to claim 1, further comprising:

a determination unit configured to, if the job designates that one of the plurality of inserter trays feeds the insertion sheet and if the one of the plurality of inserter trays runs out of sheets, determine whether the one of the plurality of inserter trays stores same type and size of sheets as sheets that are stored in another one of the plurality of inserter trays.

4. The image forming system according to claim 3, further comprising:

an allocation unit configured to allocate the plurality of inserter trays to a same group, wherein the determination unit is configured to, in a case where the plurality of inserter trays are allocated to the same group, determine that the another one of the plurality of inserter trays stores the same type and size of sheets as sheets that are stored in the one of the plurality of inserter trays.

5. The image forming system according to claim 3, wherein if the determination unit determine that the plurality of inserter trays are not allocated to a same group, when sheets that are stored in the one of the plurality of inserter trays run out during execution of the job in which a sheet feeding source of the insertion sheet is set to the one of the plurality of inserter trays, the control unit temporarily stops the job without switching from the one of the plurality of inserter trays to the another one of the plurality of inserter trays.

6. The image forming system according to claim 3, further comprising:

a designation unit configured to designate, for every tray, a size of sheets to be loaded and a type indicating that the sheets are one of recording sheets or insertion sheets.

7. The image forming system according to claim 1, wherein the plurality of sheet feeding trays are provided in an image forming apparatus, and the plurality of inserter trays are provided in the inserter unit.

8. The image forming system according to claim 1, wherein the insertion sheet is one of a front cover sheet, a back cover sheet, an interleaf sheet, and a chapter sheet.

9. The image forming system according to claim 1, wherein the control unit is further configured to, if one of the plurality of sheet feeding trays feeds the first recording sheet and the second recording sheet and if the one of the plurality of sheet feeding trays runs out of sheets, controls the another one of the plurality of sheet feeding trays to feed a sheet of which type and size are same as those of the sheets running out on the one of the plurality of sheet feeding trays and continues the job.

10. An image forming system including an image forming apparatus, a controller and an inserter, the image forming apparatus comprising:

a plurality of sheet feeding trays configured to store recording sheets, the plurality of sheet feeding trays including a first sheet feeding tray capable of storing insertion sheets, a second sheet feeding tray capable of storing insertion sheets or recording sheets, and a third sheet feeding tray capable of storing recording sheets;

a first sheet sensor configured to detect a sheet stored on the first sheet feeding tray; and an image forming unit configured to form an image on recording sheets fed from the third sheet feeding tray, and to not form an image on insertion sheets fed from the first sheet feeding tray;

the controller including a control unit, and the inserter comprising:

a plurality of inserter trays provided downstream from the image forming unit in a conveyance direction of the recording sheets and the insertion sheets the plurality of inserter trays including a first inserter tray capable of storing insertion sheets and a second inserter tray capable of storing insertion sheets;

a second sheet sensor configured to detect a sheet stored on the first inserter tray; and an insertion unit configured to insert an insertion sheet, in accordance with a job, between a plurality of recording sheets conveyed from the image forming unit, wherein the control unit is configured to accept a job, and control the image formation apparatus to form images on a first recording sheet and a second recording sheet and control the image formation apparatus or the inserter to insert an insertion sheet on which an image is not formed between the first recording sheet and the second recording sheet according to the job, wherein in a case (a) where: the job designates that the insertion sheet is fed from the first inserter tray; the second sheet sensor has detected that there is no insertion sheet on the first inserter tray; and the second inserter tray stores a sheet of which type and size are same as those of the sheets running out on the first inserter trays, the control unit controls the inserter to feed the sheet as the insertion sheet from the second inserter tray, and continues the job, and wherein in a case (b) where: the job designates that the insertion sheet is fed from the first sheet feeding tray; the first sheet sensor has detected that there is no insertion sheet on the first sheet feeding tray; and the second sheet feeding tray stores a sheet of which type and size are same as those of the sheets running out on the first sheet feeding tray, the control unit controls the image formation apparatus not to feed the sheet as the insertion sheet from the second sheet feeding tray, and temporarily stops the job, and after insertion sheets are replenished in the first sheet feeding tray, the control unit resumes the job to feed one of the replenished sheets from the first sheet feeding tray.

* * * * *